US011355863B2

(12) United States Patent
Jang et al.

(10) Patent No.: US 11,355,863 B2
(45) Date of Patent: Jun. 7, 2022

(54) DISPLAY DEVICE INCLUDING ANTENNA AND METHOD OF FABRICATING THE SAME

(71) Applicant: LG Display Co., Ltd., Seoul (KR)

(72) Inventors: Lae-Bong Jang, Paju-Si (KR); Soo-In Jo, Paju-Si (KR)

(73) Assignee: LG Display Co., Ltd., Seoul (KR)

( * ) Notice: Subject to any disclaimer, the term of this patent is extended or adjusted under 35 U.S.C. 154(b) by 29 days.

(21) Appl. No.: 16/919,723

(22) Filed: Jul. 2, 2020

(65) Prior Publication Data

US 2021/0013626 A1 Jan. 14, 2021

(30) Foreign Application Priority Data

Jul. 12, 2019 (KR) ..... 10-2019-0084160

(51) Int. Cl.

| | |
|---|---|
| ***H01Q 21/06*** | (2006.01) |
| ***H01Q 1/24*** | (2006.01) |
| ***H01Q 1/38*** | (2006.01) |
| ***H01Q 19/10*** | (2006.01) |
| ***H01Q 13/22*** | (2006.01) |
| ***H01Q 15/14*** | (2006.01) |
| ***H01Q 1/22*** | (2006.01) |

(52) U.S. Cl.

CPC ..... *H01Q 21/068* (2013.01); *H01Q 1/2258* (2013.01); *H01Q 1/38* (2013.01); *H01Q 13/22* (2013.01); *H01Q 15/14* (2013.01); *H01Q 19/10* (2013.01)

(58) Field of Classification Search

CPC ..... H01Q 21/068; H01Q 1/38; H01Q 1/2258; H01Q 13/22; H01Q 15/14; H01Q 19/10; H01Q 1/243; H01Q 1/36; H01Q 1/46; H01Q 1/48; H01Q 1/50; H01Q 1/22; H01Q 13/16

See application file for complete search history.

(56) References Cited

U.S. PATENT DOCUMENTS

| | | | |
|---|---|---|---|
| 7,468,774 | B2 | 12/2008 | Sakama et al. |
| 7,557,890 | B2 | 7/2009 | Sakama et al. |
| 2002/0122006 | A1 | 9/2002 | Crawford |
| 2006/0033874 | A1 | 2/2006 | Sakama et al. |
| 2007/0046556 | A1 | 3/2007 | Waterhouse |

(Continued)

FOREIGN PATENT DOCUMENTS

| | | | | |
|---|---|---|---|---|
| CN | 101013774 | A | 8/2007 | |
| CN | 102931199 | A * | 2/2013 | ..... H01Q 1/243 |

(Continued)

OTHER PUBLICATIONS

Taiwan Intellectual Property Office, Office Action, TW Patent Application No. 109123456, dated Mar. 22, 2021, ten pages.

(Continued)

*Primary Examiner* — Hoang V Nguyen

(74) *Attorney, Agent, or Firm* — Fenwick & West LLP

(57) ABSTRACT

A display device includes: a substrate having a display area and a non-display area at a periphery of the display area; at least one unit antenna disposed in the non-display area on the substrate and having a coplanar wave guide structure; and a communication circuit unit transmitting and receiving a communication signal with the at least one unit antenna.

16 Claims, 8 Drawing Sheets

(56) References Cited

U.S. PATENT DOCUMENTS

| | | | | |
|---|---|---|---|---|
| 2008/0309836 | A1 | 12/2008 | Sakama et al. | |
| 2010/0321325 | A1 | 12/2010 | Springer et al. | |
| 2013/0229362 | A1 | 9/2013 | Liu et al. | |
| 2014/0028619 | A1 | 1/2014 | Huang et al. | |
| 2014/0132529 | A1 | 5/2014 | Jeong | |
| 2014/0220912 | A1 | 8/2014 | Chuang et al. | |
| 2014/0354494 | A1* | 12/2014 | Katz | H01Q 9/42 343/718 |
| 2016/0093943 | A1 | 3/2016 | Yang et al. | |
| 2017/0262120 | A1 | 9/2017 | Liu et al. | |
| 2019/0104212 | A1 | 4/2019 | Lee et al. | |
| 2019/0205593 | A1* | 7/2019 | Kim | H01L 27/3234 |

FOREIGN PATENT DOCUMENTS

| | | | | |
|---|---|---|---|---|
| EP | 2642588 | A2 * | 9/2013 | H01Q 1/38 |
| EP | 3471197 | A2 | 4/2019 | |
| KR | 10-2010-0053993 | A | 5/2010 | |
| TW | 200607157 | A | 2/2006 | |
| TW | 200714963 | A | 4/2007 | |
| WO | WO 2018/196302 | A1 | 11/2018 | |

OTHER PUBLICATIONS

Intellectual Property Office of the United Kingdom, Office Action, GB Patent Application No. 2010466.7, dated Dec. 21, 2020, eight pages.

Intellectual Property Office of the United Kingdom, Office Action, GB Patent Application No. 2010466.7, dated Aug. 20, 2021, five pages.

* cited by examiner

DISPLAY DEVICE INCLUDING ANTENNA AND METHOD OF FABRICATING THE SAME

CROSS REFERENCE TO RELATED APPLICATIONS

The present application claims the priority benefit of Republic of Korea Patent Application No. 10-2019-0084160 filed in Republic of Korea on Jul. 12, 2019, which is hereby incorporated by reference in its entirety.

BACKGROUND

Technical Field

The present disclosure relates to a display device including an antenna, and more particularly, to a display device including a slot antenna of a coplanar waveguide structure and a method of fabricating the display device.

Discussion of the Related Art

A mobile terminal is a portable terminal capable of transmitting and receiving a voice, a character and an image data through a wireless communication.

The mobile terminal includes a touch panel, a display panel and an antenna. The touch panel receives an information from a user, the display panel transmits an information to a user, and an antenna transmits and receives a wireless signal with a free space.

Although the antenna has been developed as an external type where the antenna is exposed outside the mobile terminal, the antenna of an internal type where the antenna is inserted into the mobile terminal has been recently suggested.

For example, a transparent film having an antenna pattern of a mesh shape may be attached to the display panel as an antenna.

In the internal type antenna, since the transparent film as the antenna is attached to the display panel, a thickness of the display panel and the mobile terminal increases.

In addition, since the antenna pattern of the transparent film as the antenna is disposed to overlap a display area of the display panel and a touch area of the touch panel, a touch performance and a display quality are deteriorated.

Further, since a coupling between a transmission line of the transparent film and a ground layer of the display panel is essential for the antenna, a performance deviation of the antenna increases according to a gap distance due to a difference of a fabrication condition.

Moreover, since an electrode (a cathode) of the display panel is used as a ground layer, a ground voltage of the antenna becomes unstable.

SUMMARY

Accordingly, the present disclosure is directed to a display device including an antenna and a method of fabricating the display device that substantially obviate one or more of the problems due to limitations and disadvantages of the related art.

An object of the present disclosure is to provide a display device including an antenna and a method of fabricating the display device where an increase of a thickness of a display panel and a mobile terminal is reduced and a deterioration of a touch performance and a display quality is reduced by forming at least one unit antenna in a non-display area of a display panel through a process for a metal layer of a display panel.

Another object of the present disclosure is to provide a display device including an antenna and a method of fabricating the display device where a performance deviation of an antenna is reduced and a ground voltage of the antenna is stabilized by directly connecting at least one unit antenna in a non-display area of a display panel to a communication circuit unit.

Additional features and advantages of the disclosure will be set forth in the description which follows, and in part will be apparent from the description, or may be learned by practice of the disclosure. These and other advantages of the disclosure will be realized and attained by the structure particularly pointed out in the written description and claims hereof as well as the appended drawings.

To achieve these and other advantages and in accordance with the purpose of the present disclosure, as embodied and broadly described herein, a display device includes: a substrate having a display area and a non-display area at a periphery of the display area; at least one unit antenna disposed in the non-display area on the substrate and having a coplanar wave guide structure; and a communication circuit unit transmitting and receiving a communication signal with the at least one unit antenna.

In another aspect, a method of fabricating a display device includes: forming a metal layer in a display area on a substrate and at least one unit antenna having a coplanar wave guide structure in a non-display area at a periphery of the display area on the substrate; and attaching a first end portion of a communication flexible printed circuit having a communication circuit unit transmitting and receiving a communication signal with the at least one unit antenna thereon to the non-display area of the substrate.

It is to be understood that both the foregoing general description and the following detailed description are explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
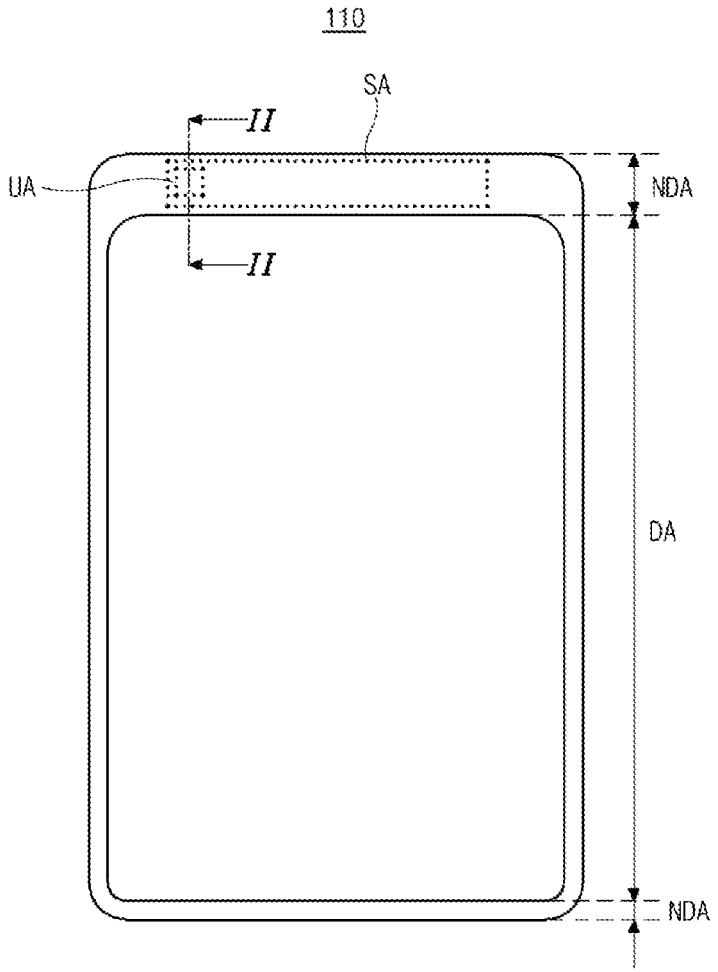
FIG. 1 is a plan view showing a display device including an antenna according to a first embodiment of the present disclosure.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," or "next," one or more other parts may be disposed between the two parts unless a more limiting term, such as "just" or "direct(ly)," is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

Hereinafter, a display device including an antenna and a method of fabricating the display device according to embodiments of the present disclosure will be described in detail with reference to the accompanying drawings. In the following description, like reference numerals designate like elements throughout. When a detailed description of well-known functions or configurations related to this document is determined to unnecessarily cloud a gist of the inventive concept, the detailed description thereof will be omitted or will be made brief.

FIG. 1 is a plan view showing a display device including an antenna according to a first embodiment of the present disclosure.

In FIG. 1, a display device 110 according to a first embodiment of the present disclosure includes a display panel DP (of FIG. 2) displaying an image, a circuit unit supplying a source voltage and a signal to the display panel DP and a frame 386 (of FIG. 7) surrounding and supporting the display panel DP and the circuit unit.

The display panel DP includes a display area DA including a plurality of pixels P and substantially displaying an image and a non-display area NDA having a plurality of pads and surrounding the display area DA.

Figure 5:
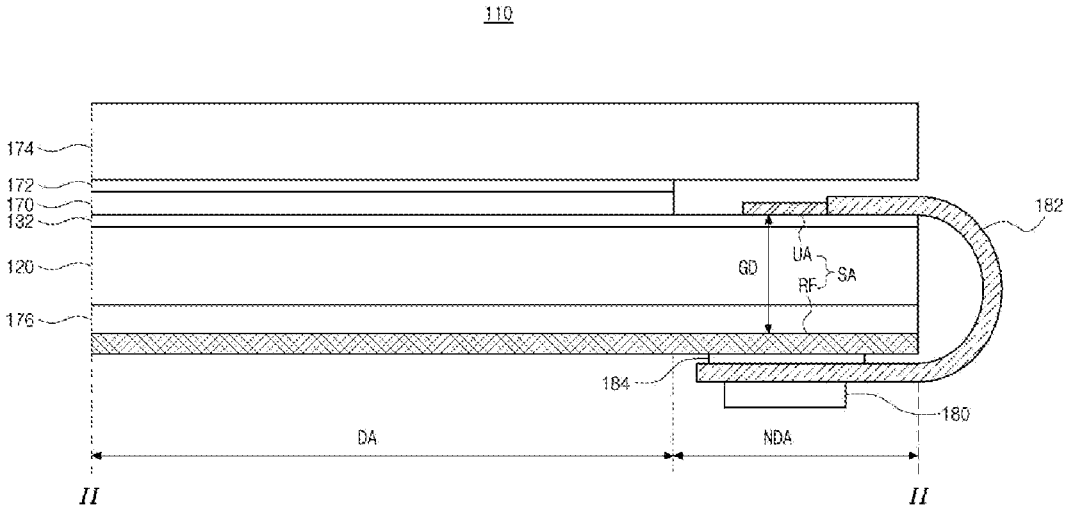
FIG. 5 is a cross-sectional view showing a display device including an antenna according to a first embodiment of the present disclosure.

Here, a slot antenna SA is disposed in the non-display area NDA of the display panel DP and includes at least one unit antenna UA of a coplanar waveguide (CPW) structure and a reflector RF (of FIG. 5).

For example, the slot antenna SA may include three or more unit antennas UA for a five-generation (5G) service of a millimeter wave (mmWave) band.

Figure 2:
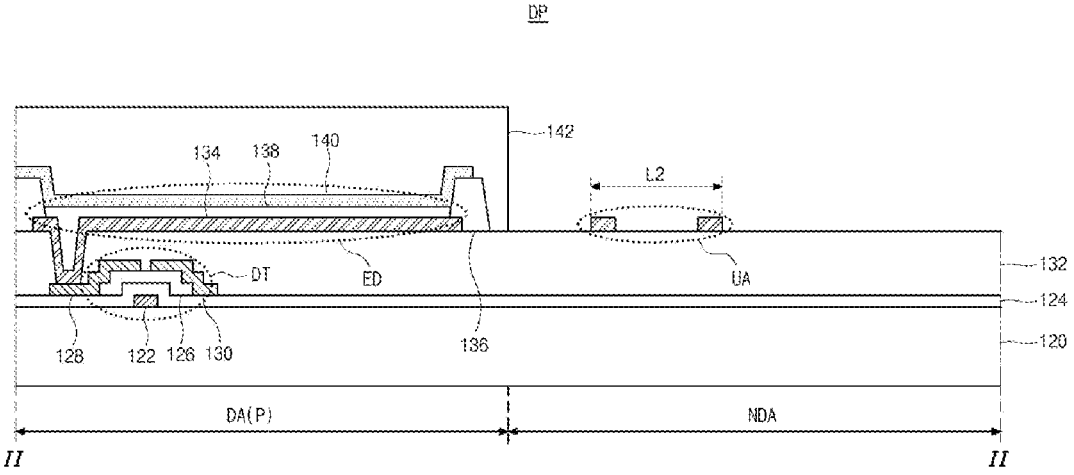
FIG. 2 is a cross-sectional view showing a display panel of a display device including an antenna according to a first embodiment of the present disclosure.

FIG. 2 is a cross-sectional view showing a display panel of a display device including an antenna according to a first embodiment of the present disclosure. FIG. 2 is taken along a line II-II of FIG. 1.

In FIG. 2, the display panel DP of the display device 110 according to the first embodiment of the present disclosure includes a substrate 120, a driving thin film transistor DT, an emitting diode ED and a unit antenna UA.

The substrate 120 may include the display area DA including the plurality of pixels P and displaying the image and the non-display area NDA at a periphery of the display area DA. The substrate 120 may be formed of a glass or a flexible material such as polyimide.

A gate electrode 122 is disposed in each pixel P of the display area DA on the substrate 120, and a gate line (not shown) is disposed along a first direction in the display area DA on the substrate 120.

A gate insulating layer 124 is disposed on a whole front surface of the substrate 120 having the gate electrode 122 and the gate line.

The gate electrode 122 and the gate line may be formed of a conductive metallic material such as aluminum (Al), copper (Cu), molybdenum (Mo), titanium (Ti), silver (Ag) or an alloy thereof.

A semiconductor layer 126 is disposed on the gate insulating layer 124 corresponding to the gate electrode 122, and a source electrode 128 and a drain electrode 130 spaced apart from each other are disposed on end portions, respectively, of the semiconductor layer 126.

A data line (not shown) is disposed along a second direction crossing the first direction in the display area DA on the gate insulating layer 124. The gate line and the data line cross each other to define the pixel P.

The source electrode 128 and the drain electrode 130 may be formed of a conductive metallic material such as aluminum (Al), copper (Cu), molybdenum (Mo), titanium (Ti), silver (Ag) or an alloy thereof.

Here, the gate electrode 122, the semiconductor layer 126, the source electrode 128 and the drain electrode 130 constitute a driving thin film transistor DT.

Although not shown, a plurality of elements such as a switching thin film transistor, a sensing thin film transistor, an emitting thin film transistor and a storage capacitor as well as the driving thin film transistor may be disposed in each pixel P on the substrate 120. The switching thin film transistor, the sensing thin film transistor and an emitting thin film transistor may have the same cross-sectional structure as the driving thin film transistor DT.

A passivation layer 132 is disposed on a whole front surface of the substrate 120 having the driving thin film transistor. The passivation layer 132 has a contact hole exposing the source electrode 128 of the driving thin film transistor.

A first electrode 134 is disposed in each pixel P of the display area DA on the passivation layer 132 and is connected to the source electrode 128 of the driving thin film transistor DT through the contact hole.

The slot antenna SA including the at least one unit antenna UA is disposed in the non-display area NDA on the passivation layer 132.

The first electrode 134 and the slot antenna DA may be formed of a single layer of a transparent conductive material such as indium tin oxide (ITO) and indium zinc oxide (IZO) or a double layer of a conductive metallic material such as aluminum (Al), copper (Cu), molybdenum (Mo), titanium (Ti), silver (Ag) or an alloy thereof.

A bank 136 is disposed on an edge portion of the first electrode 134. The bank 136 covers the edge portion of the first electrode 134 and exposes a central portion of the first electrode 134.

An emitting layer 138 is disposed inside the bank 136 of each pixel P on the first electrode 134. The emitting layer 138 may include at least one organic material layer.

For example, the emitting layer 138 may include a hole injecting layer (HIL), a hole transporting layer (HTL), an emitting material layer (EML), an electron transporting layer (ETL) and an electron injecting layer (EIL).

A second electrode 140 is disposed on a whole front surface of the substrate 120 having the emitting layer 138 and the bank 136.

The second electrode 140 may be formed of a conductive metallic material such as aluminum (Al), copper (Cu), molybdenum (Mo), titanium (Ti), silver (Ag) or an alloy thereof.

Here, the first electrode 134, the emitting layer 138 and the second electrode 140 constitute an emitting diode ED.

For example, the first electrode 134 and the second electrode 140 may be an anode and a cathode, respectively, and a material for the first electrode 134 may have a work function higher than a work function of a material for the second electrode 140.

A sealing layer 142 is disposed in the display area DA on the emitting diode ED to cover the bank 136 and the second electrode 140.

The sealing layer 142 may reduce an external moisture or an external oxygen from permeating the emitting layer 138 of the emitting diode ED and may have a thin film encapsulation structure where a plurality of organic material layers and a plurality of inorganic material layers are alternately laminated.

Figure 3:
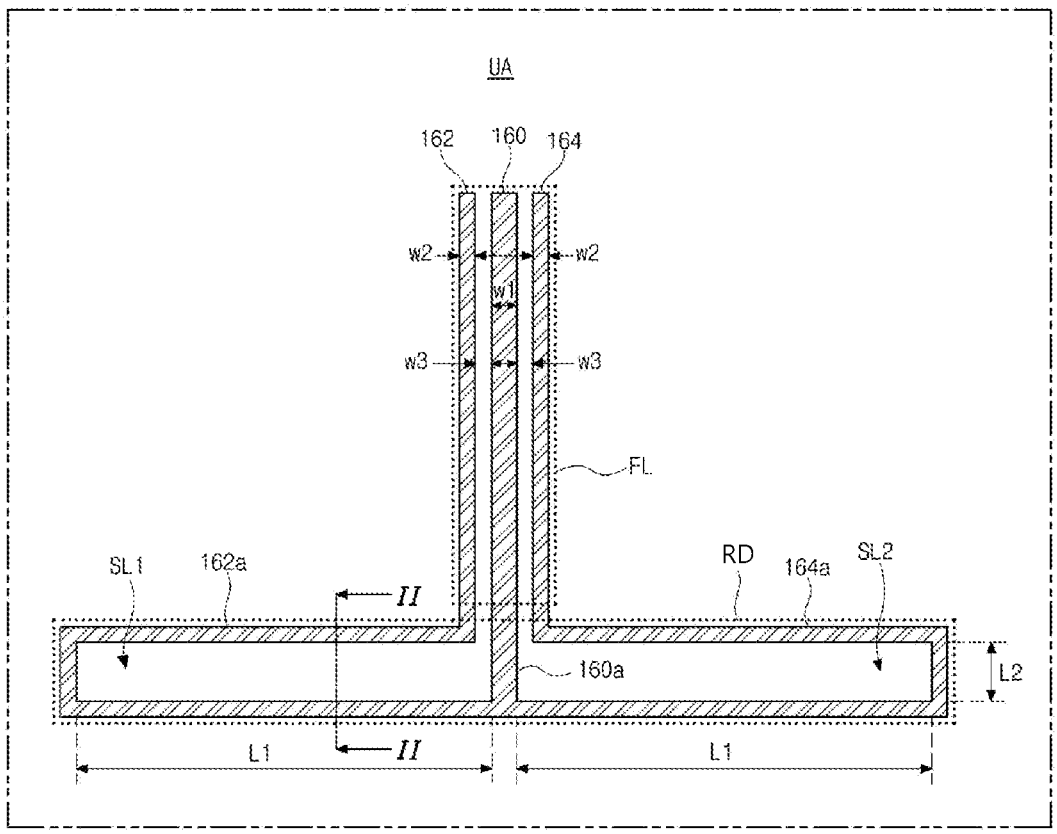
FIG. 3 is a plan view showing a unit antenna of a display device including an antenna according to a first embodiment of the present disclosure.

FIG. 3 is a plan view showing a unit antenna of a display device including an antenna according to a first embodiment of the present disclosure.

In FIG. 3, the at least one unit antenna UA of the slot antenna SA disposed on the display panel DP of the display device 110 according to the first embodiment of the present disclosure includes a feed line FL and a radiator RD.

The feed line FL includes a transmission line 160 transmitting a communication signal and first and second ground lines 162 and 164 having a ground voltage and disposed at left and right sides, respectively, of the transmission line 160.

First end portions of the transmission line 160 and the first and second ground lines 162 and 164 may be connected to pads in the non-display area NDA of the display panel DP to receive the communication signal and the ground voltage, respectively, from a communication circuit unit 180 (of FIG. 5).

The transmission line 160 is disposed at a central portion of the unit antenna UA and has a first width w1. Each of the first and second ground lines 162 and 164 has a second width w2, and the transmission line 160 is spaced apart from each of the first and second ground lines 162 and 164 by a third width w3.

Here, the first width w1 and the third width w3 may be proportional to each other such that the feed line FL has a characteristic impedance of 50 ohm.

In the slot antenna SA, the feed line FL may be designed to have a characteristic impedance of 50 ohm, and a characteristic impedance $Z_0$ of the feed line FL may be calculated from the following equations.

$$Z_0=(30\pi/\sqrt{20})\{K(k')/K(k)\},$$

$$K(k')/K(k)=[(1/\pi)\ln\{2(1+\sqrt{k'})/(1-\sqrt{k'})\}]-1 \text{ for } (0\le k\le 0.7) \text{ and}$$

$$(1/\pi)\ln\{2(1+\sqrt{k})/(1-\sqrt{k})\} \text{ for } (0.7\le k\le 1)$$

$$K'(k)=K(k'),k'=\sqrt{(1-k2)}$$

$$k=a/b,a=w1/2,b=(w1/2)+w3$$

For example, when the first width w1 of the transmission line 160 is reduced, the third width w3 between the transmission line 160 and the first and second ground lines 162 and 164 may be reduced for the feed line FL to have a characteristic impedance of 50 ohm.

Each of the first width w1 of the transmission line 160 and the second width w2 of the first and second ground lines 162 and 164 may be equal to or greater than 10 μm. When each of the first and second widths w1 and w2 is smaller than 10 μm, a performance of the slot antenna SA may be deteriorated due to loss. The first and second widths w1 and w2 may increase within a permissible limit of an area for the slot antenna SA.

The radiator RD includes a transmission extending line 160*a* and first and second ground extending lines 162*a* and 164*a*. The transmission extending line 160*a* is connected to a second end portion of the transmission line 160 and has an "I" shape (linear bar shape). The first and second ground extending lines 162*a* and 164*a* are connected to second end portions of the first and second ground lines 162 and 164, respectively, and each of the first and second ground extending lines 162*a* and 164*a* has a "U" shape (bent bar shape). The transmission extending line 160*a* and the first ground extending line 162*a* constitute a first slot SL1 transmitting and receiving (transceiving) a wireless signal (a radio wave), and the transmission extending line 160*a* and the second ground extending line 164*a* constitute a second slot SL2 transmitting and receiving a wireless signal.

Each of the first and second slots SL1 and SL2 has a first length L1 along a first direction perpendicular to the transmission line 160 and the first and second ground lines 162 and 164 and has a second length L2 along a second direction parallel to the transmission line 160 and the first and second ground lines 162 and 164. The first length L1 may correspond to ½ (half) of a wavelength (λ) of a communication signal transmitted through the transmission line 160 (L1~λ/2, 2L1~λ).

To reduce performance deterioration of the slot antenna SA, the second length L2 may be equal to or greater than 1/20 of a wavelength (λ) of a communication signal transmitted through the transmission line 160 and may be equal to or smaller than ¼ of a wavelength (λ) of a communication signal transmitted through the transmission line 160 (λ/20≤L2≤λ/4).

For example, the first length L1 may be about 4.15 mm, and the second length L2 may be about 0.8 mm.

Although the transmission line 160 is disposed at a central portion of the unit antenna UA and the first and second slots SL1 and SL2 are symmetrically disposed with respect to the transmission line 160 in the first embodiment, the transmission line and the first and second slots may be asymmetrically disposed in another embodiment.

Figure 4:
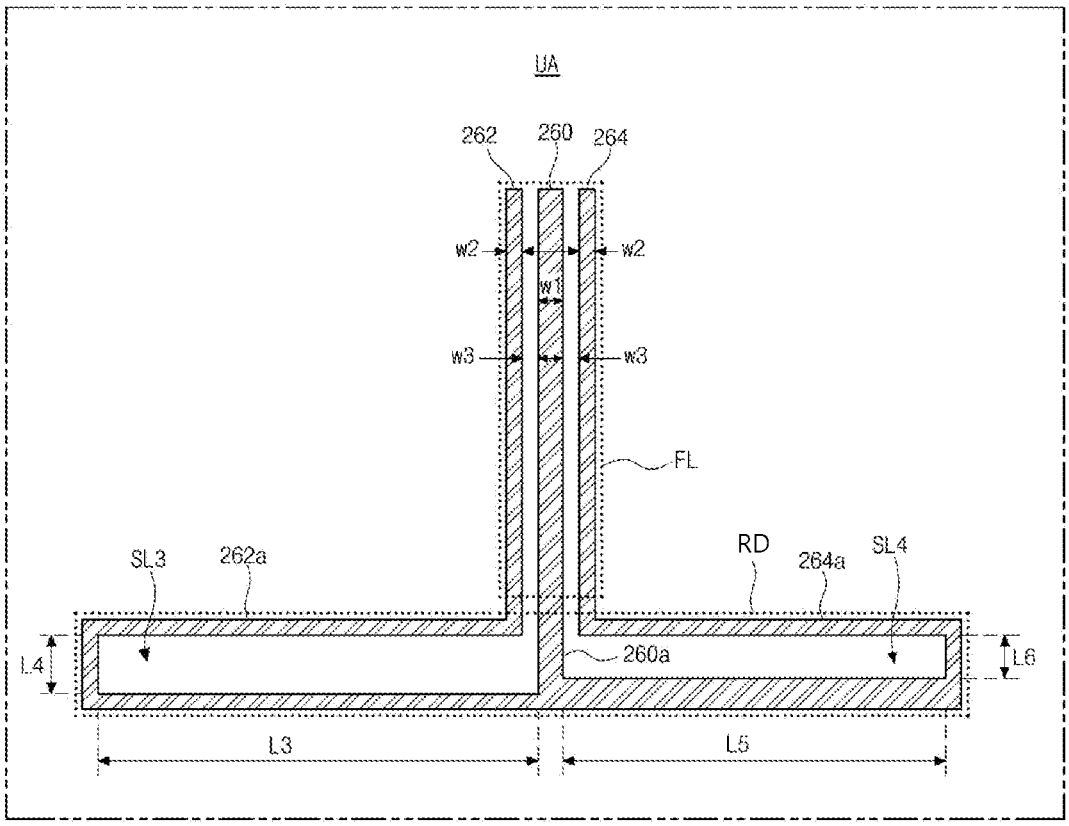
FIG. 4 is a plan view showing a unit antenna of a display device including an antenna according to a second embodiment of the present disclosure.

FIG. 4 is a plan view showing a unit antenna of a display device including an antenna according to a second embodiment of the present disclosure.

In FIG. 4, at least one unit antenna UA of a slot antenna SA disposed on a display panel DP of a display device according to a second embodiment of the present disclosure includes a feed line FL and a radiator RD.

The feed line FL includes a transmission line 260 transmitting a communication signal and first and second ground lines 262 and 264 having a ground voltage and disposed at left and right sides, respectively, of the transmission line 260.

First end portions of the transmission line 260 and the first and second ground lines 262 and 264 may be connected to pads in a non-display area NDA of the display panel DP to receive the communication signal and the ground voltage, respectively, from a communication circuit unit 180 (of FIG. 5).

The transmission line 260 is disposed at a biased portion from a central portion of the unit antenna UA and has a first width w1. Each of the first and second ground lines 262 and 264 has a second width w2, and the transmission line 260 is spaced apart from each of the first and second ground lines 262 and 264 by a third width w3.

Here, the first width w1 and the third width w3 may be proportional to each other such that the feed line FL has a characteristic impedance of 50 ohm.

Each of the first width w1 of the transmission line 260 and the second width w2 of the first and second ground lines 262 and 264 may be equal to or greater than 10 μm. When each of the first and second widths w1 and w2 is smaller than 10 μm, a performance of the slot antenna SA may be deteriorated due to a loss. The first and second widths w1 and w2 may increase within a permissible limit of an area for the slot antenna SA.

The radiator RD includes a transmission extending line 260*a* and first and second ground extending lines 262*a* and 264*a*. The transmission extending line 260*a* is connected to a second end portion of the transmission line 260 and has an "I" shape (linear bar shape). The first and second ground extending lines 262*a* and 264*a* are connected to second end portions of the first and second ground lines 262 and 264, respectively, and each of the first and second ground extending lines 262*a* and 264*a* has a "U" shape (bent bar shape). The transmission extending line 260*a* and the first ground extending line 262*a* constitute a third slot SL3 transmitting and receiving (transceiving) a wireless signal (a radio wave), and the transmission extending line 260*a* and the second ground extending line 264*a* constitute a fourth slot SL4 transmitting and receiving a wireless signal.

The third slot SL3 has third and fourth lengths L3 and L4 along first and second directions, respectively, perpendicular to and parallel to the transmission line 260 and the first ground line 262, and the fourth slot SL4 has fifth and sixth lengths L5 and L6 along the first and second directions, respectively, perpendicular to and parallel to the transmission line 260 and the second ground line 264.

Here, to improve a wireless communication performance such as a frequency response property and a bandwidth of the slot antenna SA, the third and fifth lengths L3 and L5 may be determined different from each other, and the fourth and sixth lengths L4 and L6 may be determined different from each other.

For example, when the slot antenna SA (of FIG. 4) of the second embodiment is compared with the slot antenna SA (of FIG. 3) of the first embodiment, the third and fourth lengths L3 and L4 of the third slot SL3 (of FIG. 4) may be greater than the first and second lengths L1 and L2 of the first slot SL1 (of FIG. 3), respectively, and the fifth and sixth lengths L5 and L6 of the fourth slot SL4 (of FIG. 4) may be smaller than the first and second lengths L1 and L2 of the second slot SL2 (of FIG. 3), respectively.

As a result, the third slot SL3 may have an area greater than an area of the first slot SL1, and a center frequency of the third slot SL3 having a greater area than the first slot SL1 may be lower than a center frequency of the first slot SL1. In addition, the fourth slot SL4 may have an area smaller than an area of the second slot SL2, and a center frequency of the fourth slot SL4 having a smaller area than the second slot SL2 may be higher than a center frequency of the second slot SL2. For example, each of the center frequencies of the first and second slots SL1 and SL2 may be 28 GHz, the center frequency of the third slot SL3 is lower than 28 GHz, and the center frequency of the fourth slot SL4 is higher than 28 GHz.

To reduce performance deterioration of the slot antenna SA, each of the fourth and sixth lengths L4 and L6 may be equal to or greater than 1/20 of a wavelength (λ) of a communication signal transmitted through the transmission line 260 and may be equal to or smaller than ¼ of a wavelength (λ) of a communication signal transmitted through the transmission line 260 (λ/20≤L4≤λ/4, λ/20≤L6≤λ/4).

In the second embodiment, to improve a wireless communication performance such as a frequency response property and a bandwidth of the slot antenna SA, the transmission line 260 and the third and fourth slots SL3 and SL4 may be formed asymmetrically.

FIG. 5 is a cross-sectional view showing a display device including an antenna according to a first embodiment of the present disclosure. For illustration's convenience, the substrate 120, the passivation layer 132 and the unit antenna UA of the display panel DP of the display device 110 are shown and other elements of the display panel DP are not shown in FIG. 5.

In FIG. 5, the display device 110 according to the first embodiment of the present disclosure includes the display panel DP displaying an image, the circuit unit supplying a source voltage and a signal to the display panel DP and the frame 386 (of FIG. 7) surrounding and supporting the display panel DP and the circuit unit.

The display panel DP includes the substrate 120, the driving thin film transistor DT, the emitting diode ED and the at least one unit antenna UA. The display panel DP may further include other elements in another embodiment.

A reflection preventing layer 170 is disposed in the display area DA on a top surface of the display panel DP. The reflection preventing layer 170 may reduce an incident light from an exterior from being reflected on the display panel DP that would disturb the image.

For example, the reflection preventing layer 170 may include a retardation layer and a linear polarizing layer.

A first adhesive layer 172 is disposed in the display area DA on the reflection preventing layer 170, and a protecting substrate 174 corresponding to the substrate 120 is disposed on the first adhesive layer 172.

The first adhesive layer 172 may be formed of an optically clear adhesive (OCA), and the protecting substrate 174 referred to as a cover glass may be formed of a glass.

A cushion layer 176 is disposed on a whole rear surface of the substrate 120 of the display panel DP, and the reflector RF is disposed on a whole rear surface of the substrate having the cushion layer 176.

The at least one unit antenna UA and the reflector RF are spaced apart from each other by a gap distance GD equal to or greater than a reference value due to the cushion layer 176. The cushion layer 176 may be omitted in another embodiment where the gap distance GD is equal to or greater than a reference value due to the substrate 120.

The reflector RF improves a directivity of the slot antenna SA by reflecting the wireless signal (radio wave) transmitted from the radiator RD of the at least one unit antenna UA to a lower portion of the display panel DP toward an upper portion of the display panel DP.

For example, the reflector RF may be formed of copper (Cu) and may be attached to the cushion layer 176 as a film type.

The circuit unit includes a display circuit unit (not shown) and a communication circuit unit 180. The display circuit unit supplies a source voltage and a display signal for an image display to the display panel DP, and the communication circuit unit 180 supplies a source voltage and a communication signal for a wireless communication to the slot antenna SA.

The display circuit unit may include a gate driving part supplying a gate signal applied to a gate line of the display panel DP and a data driving part supplying a data signal applied to a data line of the display panel DP. The display circuit unit may be mounted on a display flexible printed circuit (FPC) connected to the non-display area NDA of one side of the display panel DP.

Although not shown, a touch panel or a touch sensing layer for a touch sensing may be disposed between the substrate 120 and the protecting substrate 174, and the circuit unit may further include a touch circuit unit supplying a source voltage and a touch transmitting signal to and receiving a touch receiving signal from the touch panel or the touch sensing layer.

The communication circuit unit 180 may be mounted on a communication flexible printed circuit 182 connected to the non-display area NDA of another side of the display panel DP and may transmit and receive the communication signal with the slot antenna SA.

For example, the display circuit unit and the communication circuit unit 180 may be connected to two sides, respectively, of the display panel DP to minimize an electric interference and a mechanical complexity.

The communication flexible printed circuit 182 may be bent toward the rear surface of the display panel DP to be attached to the reflector RF through a second adhesive layer 184 such as a double sided tape.

The communication flexible printed circuit 182 may include a high frequency flexible printed circuit formed of a material having a relatively low loss tangent for a millimeter wave (mmWave). For example, the material of the communication flexible printed circuit 182 may include NF-30 of Taconic or a low dielectric constant polyimide (LCP).

As a result, a wireless line loss (RF line loss) between the communication circuit unit 180 and the unit antenna (UA) of the slot antenna SA may be minimized by attaching the communication circuit unit 180 to the high frequency flexible printed circuit.

FIGS. 6A to 6D are cross-sectional views showing a method of fabricating a display device according to a first embodiment of the present disclosure. For illustration's convenience, the substrate 120, the passivation layer 132 and the unit antenna UA of the display panel DP of the display device 110 are shown and other elements of the display panel DP are not shown in FIGS. 6A to 6D.

Figure 6A:
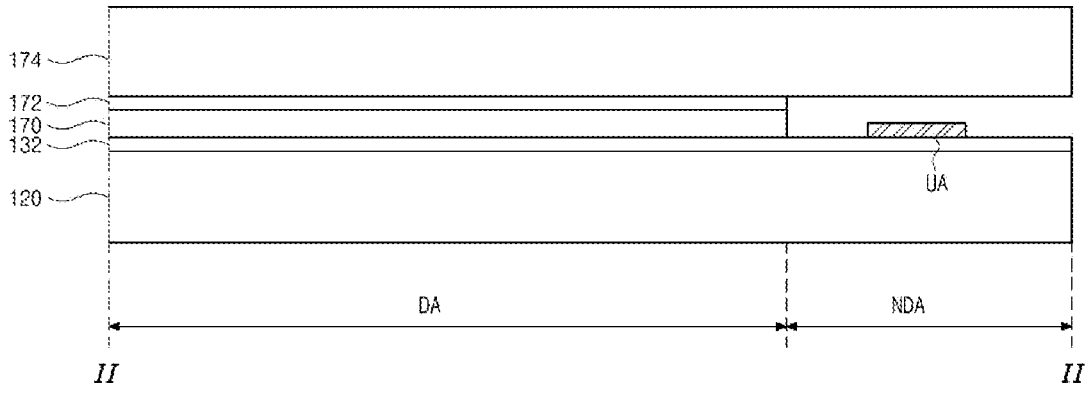
FIGS. 6A to 6D are cross-sectional views showing a method of fabricating a display device according to a first embodiment of the present disclosure.

In FIG. 6A, the reflection preventing layer 170 is formed in the display area DA on the passivation layer 132 of the substrate 120 having the driving thin film transistor DT, the emitting diode ED and the at least one unit antenna UA.

Next, the first adhesive layer 172 is formed in the display area DA on the reflection preventing layer 170, and the protecting substrate 174 corresponding to the substrate 120 is attached to the first adhesive layer 172.

Figure 6B:
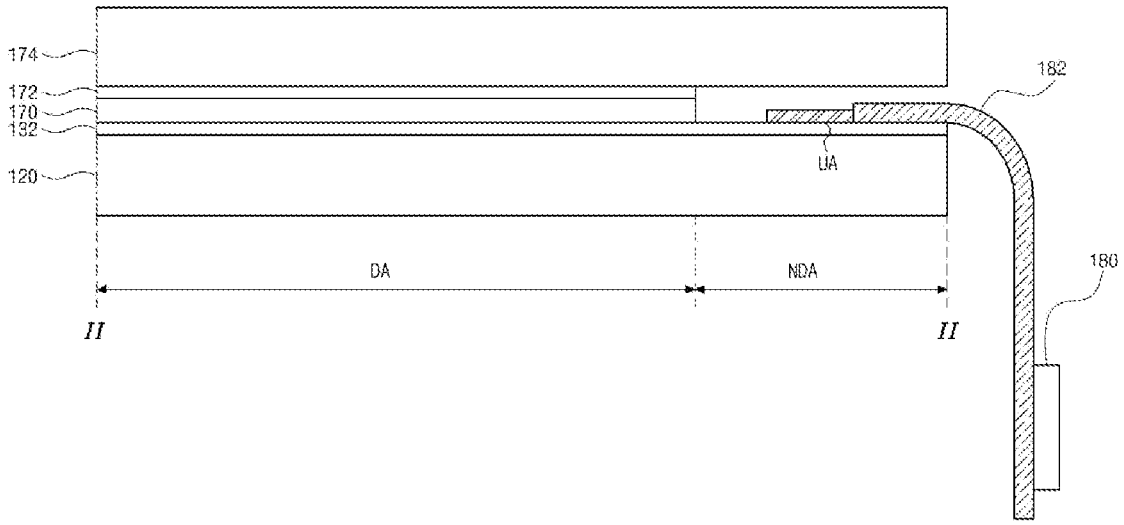

In FIG. 6B, the communication flexible printed circuit 182 having the communication circuit unit 180 thereon is attached to the communication pad which is disposed in the non-display area NDA of one side of the display panel DP and connected to the at least one unit antenna UA.

Although not shown, after or before the communication flexible printed circuit 182 is attached, the display flexible printed circuit having the display circuit unit thereon may be attached to the display pad which is disposed in the non-display area NDA of another side of the display panel DP and connected to the gate line and the data line.

In addition, before the reflection preventing layer 170, the first adhesive layer 172 and the protecting substrate 174 are formed, the communication flexible printed circuit 182 may be attached to the communication pad.

Figure 6C:
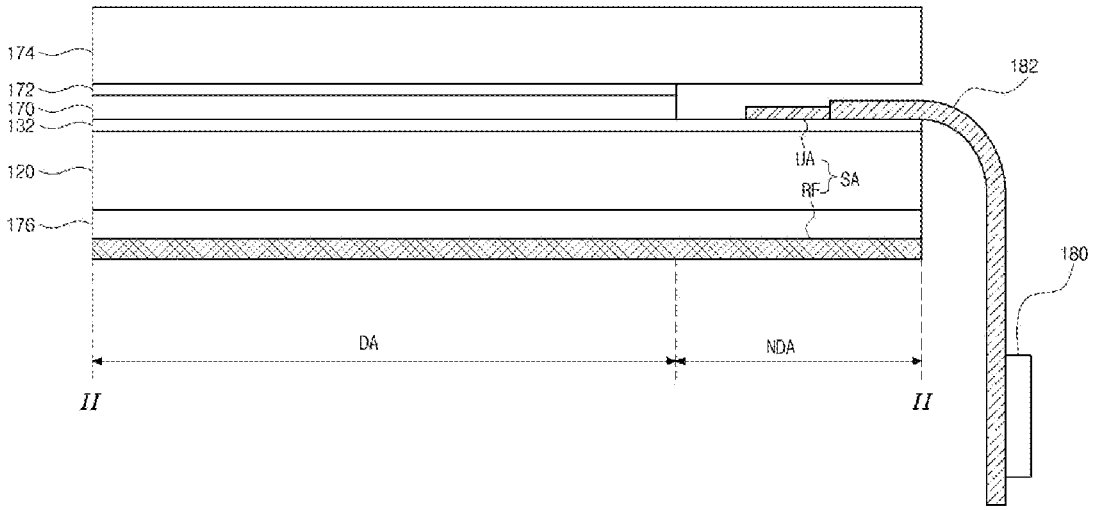

In FIG. 6C, the cushion layer 176 is formed on a whole rear surface of the substrate 120 of the display panel DP, and the reflector RF is formed on a whole rear surface of the substrate 120 having the cushion layer 176.

Figure 6D:
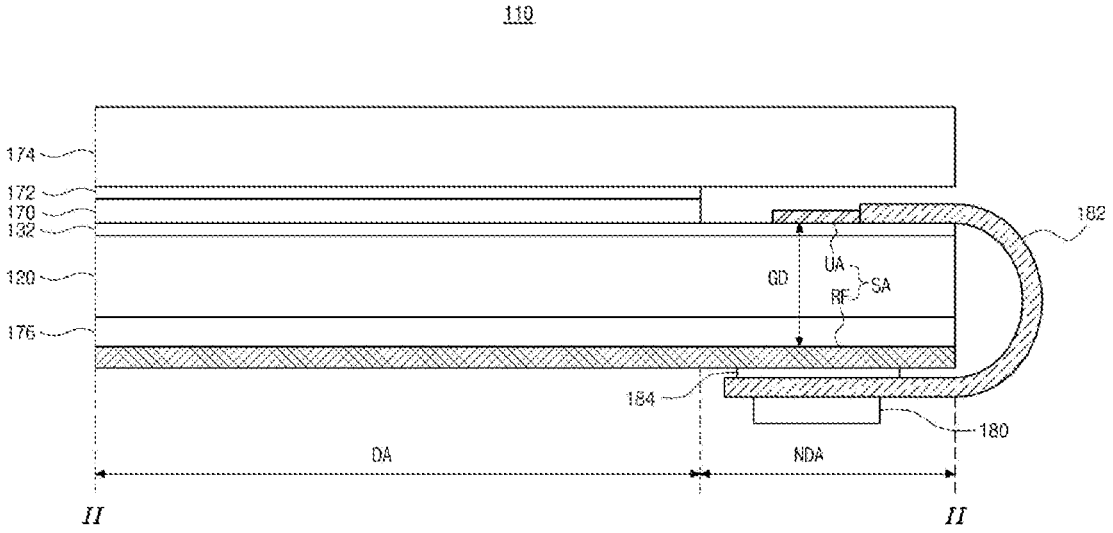

In FIG. 6D, the communication flexible printed circuit 182 attached to the communication pad is bent toward the rear surface of the display panel DP, and the bent communication flexible printed circuit 182 is attached to the cushion layer 176 using the second adhesive layer 184 such as a double sided tape.

Figure 7:
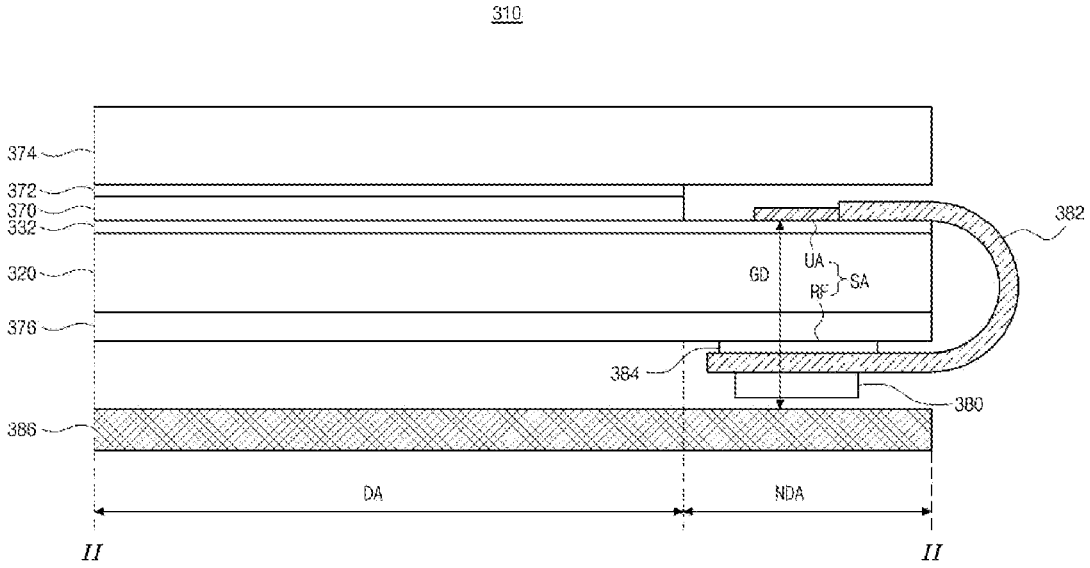
FIG. 7 is a cross-sectional view showing a display device including an antenna according to a third embodiment of the present disclosure.

Next, the display device 110 is completed by surrounding the display panel DP and the circuit unit with the frame 386 (of FIG. 7).

In the display device 110 according to the first embodiment of the present disclosure, the slot antenna SA of a coplanar waveguide (CPW) structure including the at least one unit antenna UA and the reflector RF is obtained by forming the at least one unit antenna UA in the non-display area NDA of one side of the front surface of the display panel DP and forming the reflector RF on the whole rear surface of the display panel DP.

Since the feed line FL and the radiator RD of the at least one unit antenna UA are formed through a process for the metal layer of the display panel DP, the feed line FL and the radiator RD of the at least one unit antenna UA have the same material and the same layer as the metal layer of the display panel DP, and an increase of the thickness of the display device 110 is prevented.

Since the at least one unit antenna UA is disposed in the non-display area NDA, a deterioration of the touch performance and the display quality is prevented and transmitting and receiving the wireless signal are realized even under a hand grip condition. Specifically, a performance and a quality of a five-generation (5G) service of a millimeter wave (mmWave) band are improved through an entire surface radiation of the wireless signal.

Since the at least one unit antenna UA is directly connected to the additional communication circuit unit 180, a performance deviation of the slot antenna SA is minimized and a ground voltage of the slot antenna SA is stabilized.

FIG. 7 is a cross-sectional view showing a display device including an antenna according to a third embodiment of the present disclosure. For illustration's convenience, a substrate 320, a passivation layer 332 and a unit antenna UA of a display panel DP of a display device 310 are shown and other elements of the display panel DP are not shown in FIG. 7.

In FIG. 7, a display device 310 according to the third embodiment of the present disclosure includes a display panel DP displaying an image, a circuit unit supplying a source voltage and a signal to the display panel DP and a frame 386 surrounding and supporting the display panel DP and the circuit unit.

The display panel DP includes a substrate 320, a driving thin film transistor DT, an emitting diode ED and at least one unit antenna UA. The display panel DP may further include other elements in another embodiment.

A reflection preventing layer 370 is disposed in a display area DA on a top surface of the display panel DP. A reflection preventing layer 370 may reduce reflection of an incident light from an exterior on the display panel DP that would disturb the image.

For example, the reflection preventing layer 370 may include a retardation layer and a linear polarizing layer.

A first adhesive layer 372 is disposed in the display area DA on the reflection preventing layer 370, and a protecting substrate 374 corresponding to the substrate 320 is disposed on the first adhesive layer 372.

The first adhesive layer 372 may be formed of an optically clear adhesive (OCA), and the protecting substrate 374 referred to as a cover glass may be formed of a glass.

A cushion layer 376 is disposed on a whole rear surface of the substrate 320 of the display panel DP.

The at least one unit antenna UA and the reflector RF are spaced apart from each other by a gap distance GD equal to or greater than a reference value due to the cushion layer 376. The cushion layer 376 may be omitted in another embodiment where the gap distance GD is equal to or greater than a reference value due to the substrate 320.

The circuit unit includes a display circuit unit (not shown) and a communication circuit unit 380. The display circuit unit supplies a source voltage and a display signal for an image display to the display panel DP, and the communication circuit unit 380 supplies a source voltage and a communication signal for a wireless communication to the slot antenna SA.

The display circuit unit may include a gate driving part supplying a gate signal applied to a gate line of the display panel DP and a data driving part supplying a data signal applied to a data line of the display panel DP. The display circuit unit may be mounted on a display flexible printed circuit (FPC) connected to the non-display area NDA of one side of the display panel DP.

Although not shown, a touch panel or a touch sensing layer for a touch sensing may be disposed between the substrate 320 and the protecting substrate 374, and the circuit unit may further include a touch circuit unit supplying a source voltage and a touch transmitting signal to and receiving a touch receiving signal from the touch panel or the touch sensing layer.

The communication circuit unit 380 may be mounted on a communication flexible printed circuit 382 connected to the non-display area NDA of another side of the display panel DP and may transmit and receive the communication signal with the slot antenna SA.

For example, the display circuit unit and the communication circuit unit 380 may be connected to two sides, respectively, of the display panel DP to reduce electric interference and a mechanical complexity.

The communication flexible printed circuit 382 may be bent toward the rear surface of the display panel DP to be attached to the cushion layer 376 through a second adhesive layer 384 such as a double sided tape.

The communication flexible printed circuit 382 may include a high frequency flexible printed circuit formed of a material having a relatively low loss tangent for a millimeter wave (mmWave). For example, the material of the communication flexible printed circuit 382 may include NF-30 of Taconic or a low dielectric constant polyimide (LCP).

As a result, a wireless line loss (RF line loss) between the communication circuit unit 380 and the unit antenna (UA) of the slot antenna SA may be minimized by attaching the communication circuit unit 380 to the high frequency flexible printed circuit.

A frame 386 surrounding and supporting the display panel DP and the circuit unit is disposed under the communication circuit unit 380. The frame 386 functions as a reflector RF.

For example, the reflector RF may be the frame 386 of a metallic material or a film of a metallic material for radiating a heat or grounding attached to an inner surface or an outer surface of the frame 386. The metallic material may include copper (Cu).

The reflector RF improves a directivity of the slot antenna SA by reflecting the wireless signal (radio wave) transmitted from the radiator RD of the at least one unit antenna UA to a lower portion of the display panel DP toward an upper portion of the display panel DP.

In the display device 310 according to the third embodiment of the present disclosure, the slot antenna SA of a coplanar waveguide (CPW) structure including the at least one unit antenna UA and the reflector RF is obtained by forming the at least one unit antenna UA in the non-display area NDA of one side of the front surface of the display panel DP and forming the reflector RF on the whole rear surface of the display panel DP.

Since the feed line FL and the radiator RD of the at least one unit antenna UA are formed through a process for the metal layer of the display panel DP, the feed line FL and the radiator RD of the at least one unit antenna UA have the same material and the same layer as the metal layer of the display panel DP, and an increase of the thickness of the display device 310 is prevented.

Since the frame 386 of a metallic material is used as the reflector RF, an increase of the thickness of the display device 310 is further prevented, and a fabrication process is simplified.

Since the at least one-unit antenna UA is disposed in the non-display area NDA, a deterioration of the touch performance and the display quality is reduced and transmitting and receiving the wireless signal are realized even under a hand grip condition. Specifically, a performance and a quality of a five-generation (5G) service of a millimeter wave (mmWave) band are improved through an entire surface radiation of the wireless signal.

Since the at least one unit antenna UA is directly connected to the additional communication circuit unit 380, a performance deviation of the slot antenna SA is minimized and a ground voltage of the slot antenna SA is stabilized.

Although the display device exemplarily includes an organic light emitting diode display device in the first to third embodiments, the display device may include a liquid crystal display device in another embodiment. When the display device includes a liquid crystal display device, a thin film transistor, a pixel electrode and a common electrode may be disposed in the display area of the display panel, and the at least one unit antenna having the same material and the same layer as one of a gate electrode, a source electrode, a drain electrode, a pixel electrode and a common electrode of the thin film transistor through the same process for one of the gate electrode, the source electrode, the drain electrode, the pixel electrode and the common electrode may be disposed in the non-display area of the display panel.

Consequently, in the display device including the antenna and the method of fabricating the display device according to the first to third embodiments of the present disclosure, an increase of a thickness of the display panel and the mobile terminal is reduced and a deterioration of a touch performance and a display quality is reduced by forming the at least one unit antenna in the non-display area of the display panel through the same process for the metal layer of the display panel.

In addition, a performance deviation of an antenna is reduce and a ground voltage of the antenna is stabilized by forming the at least one unit antenna in the non-display area of the display panel and directly connecting the at least one unit antenna to a communication circuit unit.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A display device, comprising:

a substrate having a display area and a non-display area at a periphery of the display area;

at least one unit antenna disposed in the non-display area on the substrate and having a coplanar wave guide structure; and a communication circuit unit transmitting and receiving a communication signal with the at least one unit antenna, wherein the at least one unit antenna has a same layer and a same material as one of a gate electrode, a source electrode, a drain electrode, a pixel electrode, and a common electrode of the display area, wherein the at least one unit antenna comprises:

a feed line transmitting the communication signal and a ground voltage; and a radiator transmitting and receiving a wireless signal corresponding to the communication signal, wherein the feed line includes a transmission line transmitting the communication signal, a first ground line transmitting the ground voltage and disposed at a left side of the transmission line, and a second ground line transmitting the ground voltage and disposed at a right side of the transmission line, wherein the radiator includes a transmission extending line connected to the transmission line, a first ground extending line connected to the first ground line, and a second ground extending line connected to the second ground line, and wherein the transmission extending line and the first ground extending line constitute a first slot transmitting and receiving the wireless signal, and the transmission extending line and the second ground extending line constitute a second slot transmitting and receiving the wireless signal.

2. The device of claim 1, wherein the communication circuit unit is mounted on a communication flexible printed circuit, and wherein a first end portion of the communication flexible printed circuit is attached to the non-display area of the substrate and is connected to the at least one unit antenna.

3. The device of claim 2, further comprising:

a reflector disposed under the substrate, the reflector reflecting the wireless signal transmitted from the radiator.

4. The device of claim 3, wherein the reflector is disposed to contact a rear surface of the substrate, and wherein a second end portion of the communication flexible printed circuit is attached to the reflector.

5. The device of claim 4, wherein the second end portion of the communication flexible printed circuit is attached to a rear surface of the substrate, and wherein the reflector is disposed under the communication circuit unit.

6. The device of claim 1, wherein the transmission extending line has an "I" shape, the first ground extending line has a "U" shape and the second ground extending line has a "U" shape.

7. The device of claim 6, wherein at least one of the first slot or the second slot has a first length along a first direction corresponding to ½ of a wavelength of the communication signal and a second length along a second direction equal to or greater than 1/20 of the wavelength of the communication signal and be equal to or smaller than ¼ of the wavelength of the communication signal.

8. The device of claim 1, further comprising a cushion layer on a whole of a rear surface of the substrate.

9. The device of claim 1, wherein the first slot and the second slot are symmetrically disposed with respect to the transmission line.

10. The device of claim 1, wherein the first slot and the second slot are asymmetrically disposed with respect to the transmission line.

11. A method of fabricating a display device, comprising:

forming a metal layer in a display area on a substrate and at least one unit antenna having a coplanar wave guide structure in a non-display area at a periphery of the display area on the substrate; and attaching a first end portion of a communication flexible printed circuit having a communication circuit unit transmitting and receiving a communication signal with the at least one unit antenna thereon to the non-display area of the substrate, wherein the at least one unit antenna has a same layer and a same material as one of a gate electrode, a source electrode, a drain electrode, a pixel electrode, and a common electrode of the display area, wherein the at least one unit antenna comprises:

a feed line transmitting the communication signal and a ground voltage; and a radiator transmitting and receiving a wireless signal corresponding to the communication signal, wherein the feed line includes a transmission line transmitting the communication signal, a first ground line transmitting the ground voltage and disposed at a left side of the transmission line, and a second ground line transmitting the ground voltage and disposed at a right side of the transmission line, wherein the radiator includes a transmission extending line connected to the transmission line, a first ground extending line connected to the first ground line, and a second ground extending line connected to the second ground line, and wherein the transmission extending line and the first ground extending line constitute a first slot transmitting and receiving the wireless signal, and the transmission extending line and the second ground extending line constitute a second slot transmitting and receiving the wireless signal.

12. The method of claim 11, further comprising:

forming a reflector under the substrate, the reflector reflecting the wireless signal transmitted from the radiator.

13. The method of claim 12, wherein the reflector is disposed to contact a rear surface of the substrate.

14. The method of claim 13, further comprising:

attaching a second end portion of the communication flexible printed circuit to the reflector.

15. The method of claim 12, wherein the reflector includes a frame disposed under the communication circuit unit.

16. The method of claim 15, further comprising attaching a second end portion of the communication flexible printed circuit to a rear surface of the substrate.

* * * * *